US005920903A

United States Patent [19]

Koehntop et al.

[11] Patent Number: 5,920,903

[45] Date of Patent: Jul. 13, 1999

[54] CAMOUFLAGED WATERFOWL HUNTING APPAREL

[76] Inventors: Roger Koehntop; Bonnie Koehntop, both of Route 2, Box 74, Morris, Minn. 56267

[21] Appl. No.: 08/936,660

[22] Filed: Sep. 24, 1997

Related U.S. Application Data

[60] Provisional application No. 60/027,108, Sep. 27, 1996.

[51] Int. Cl.[6] ..... A41D 13/00

[52] U.S. Cl. ..... 2/69; 2/1; 2/900; 428/919

[58] Field of Search ..... 2/69, 94, 108, 2/115, 102, 1, 900; 428/919

[56] References Cited

U.S. PATENT DOCUMENTS

| | | | |
|---|---|---|---|
| D. 297,786 | 9/1988 | Braungardt | 428/919 X |
| 4,517,230 | 5/1985 | Crawford | 428/919 |
| 4,656,065 | 4/1987 | Yacovella | 428/919 |
| 5,274,848 | 1/1994 | Shamblin | 2/69 |
| 5,753,323 | 5/1998 | Andrus | 428/919 |

OTHER PUBLICATIONS

Cabelas 1994 Annual Fall Catalog, pp. 30–31, Camo garments & patterns. Sep. 1994.

*Primary Examiner*—Gloria Hale
*Attorney, Agent, or Firm*—Patterson & Keough

[57] ABSTRACT

Camouflaged apparel for use by a hunter in pursuing waterfowl, in which the apparel is designed to be observed by the pursued waterfowl, includes apparel that resembles the coloration of a selected species of waterfowl. The apparel conceals the hunter that is wearing the apparel and has an exterior appearance that visibly resembles the appearance features of the selected species of waterfowl in order to entice the waterfowl to approach the concealed hunter.

18 Claims, 4 Drawing Sheets

CAMOUFLAGED WATERFOWL HUNTING APPAREL

RELATED APPLICATIONS

This application claims the benefit of U.S. Provisional application Ser. No. 60/027,108, filed Sep. 27, 1996 and incorporated herein in its entirety by reference.

TECHNICAL FIELD

The present invention relates to apparel to be worn by hunters during waterfowl hunting activity. More particularly, the present invention is apparel that resembles the coloration of a selected species of waterfowl.

BACKGROUND OF THE INVENTION

Canada geese, snow geese and blue geese are frequently hunted in fields in which crops have already been harvested. It is the practice of Canada geese, snow geese, and blue geese to fly into such fields early in the morning, feed throughout the day, and fly out in the evening. The geese feed on residue of the crop left in the field by the harvesting machines. Swans and ducks of many different varieties also exhibit this behavior.

It is known that Canada geese, snow geese, and blue geese will settle among decoys placed in such fields. The decoys are typically colored and shaped to resemble the type of geese being hunted.

It is known that Canada geese, snow geese, and blue geese have extremely good eyesight and are capable of discriminating colors. It has always been a problem for the hunter who must be located proximate the decoys to conceal himself visually from the flying Canada geese, snow geese, and blue geese. In the past, hunters have concealed themselves within the body structure of magnum geese decoys, have positioned themselves within camouflaged trenches formed in the fields, or have lain in shallow depressions made in the field while wearing clothing that resembles the crop residue left in the field.

All the foregoing means of concealment have certain disadvantages. It is difficult to transport a magnum goose decoy shell long distances to the field. Most farmers in whose fields the goose hunting activity takes place do not want a deep trench for concealment dug. Finally, laying in a shallow depression makes it both difficult to see the approach of the geese and to rise to a shooting position to bring a shotgun to bear. There remains a need to provide a means of concealment for a hunter when hunting geese, ducks and swans that does not suffer from the aforementioned disadvantages. Additionally there is a need to affirmatively entice the waterfowl to the vicinity of the hunter as well as to conceal the hunter.

SUMMARY OF THE INVENTION

The present inventions affords the hunter the opportunity to be stationed within the field in a relatively comfortable position for the sometimes long waits that accompany goose hunting. Additionally, the present invention affords the hunter the ability to view the approach of the geese and to readily assume a shooting position, while remaining concealed. Further, the present invention provides the means for the hunter to take actions that will entice the selected waterfowl to land in the proximity of the hunter.

Camouflaged apparel for use by a hunter in pursuing waterfowl, in which the apparel is designed to be observed by the pursued waterfowl, includes apparel that resembles the coloration of a selected species of waterfowl. The apparel conceals the hunter that is wearing the apparel and has an exterior appearance that visibly resembles the appearance features of the selected species of waterfowl in order to entice the waterfowl to approach the concealed hunter.

DETAILED DESCRIPTION OF THE DRAWINGS

Figure 1:
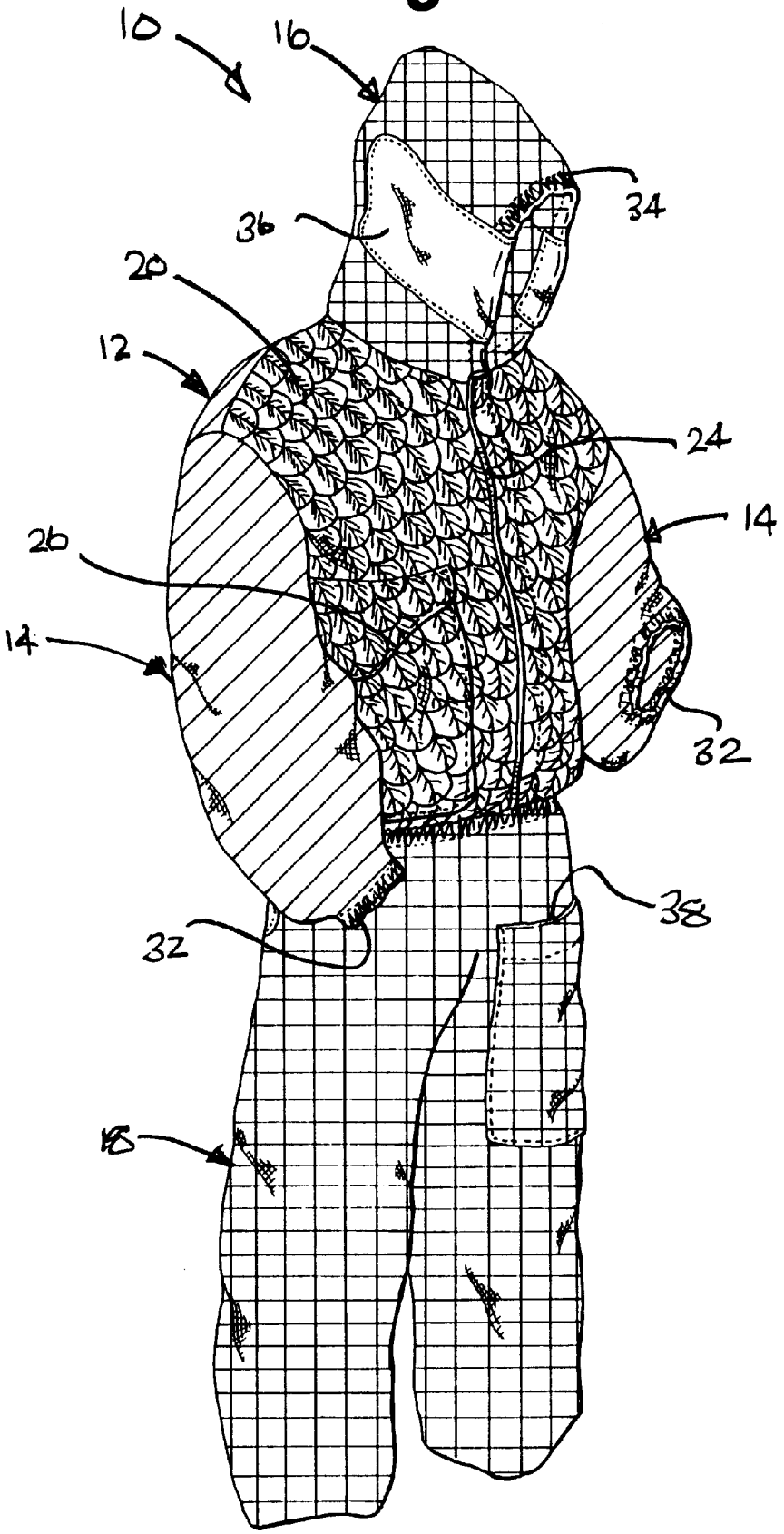
FIG. 1 is a perspective view of the camouflaged apparel of the present invention worn by a hunter depicted in phantom.
Figure 2:
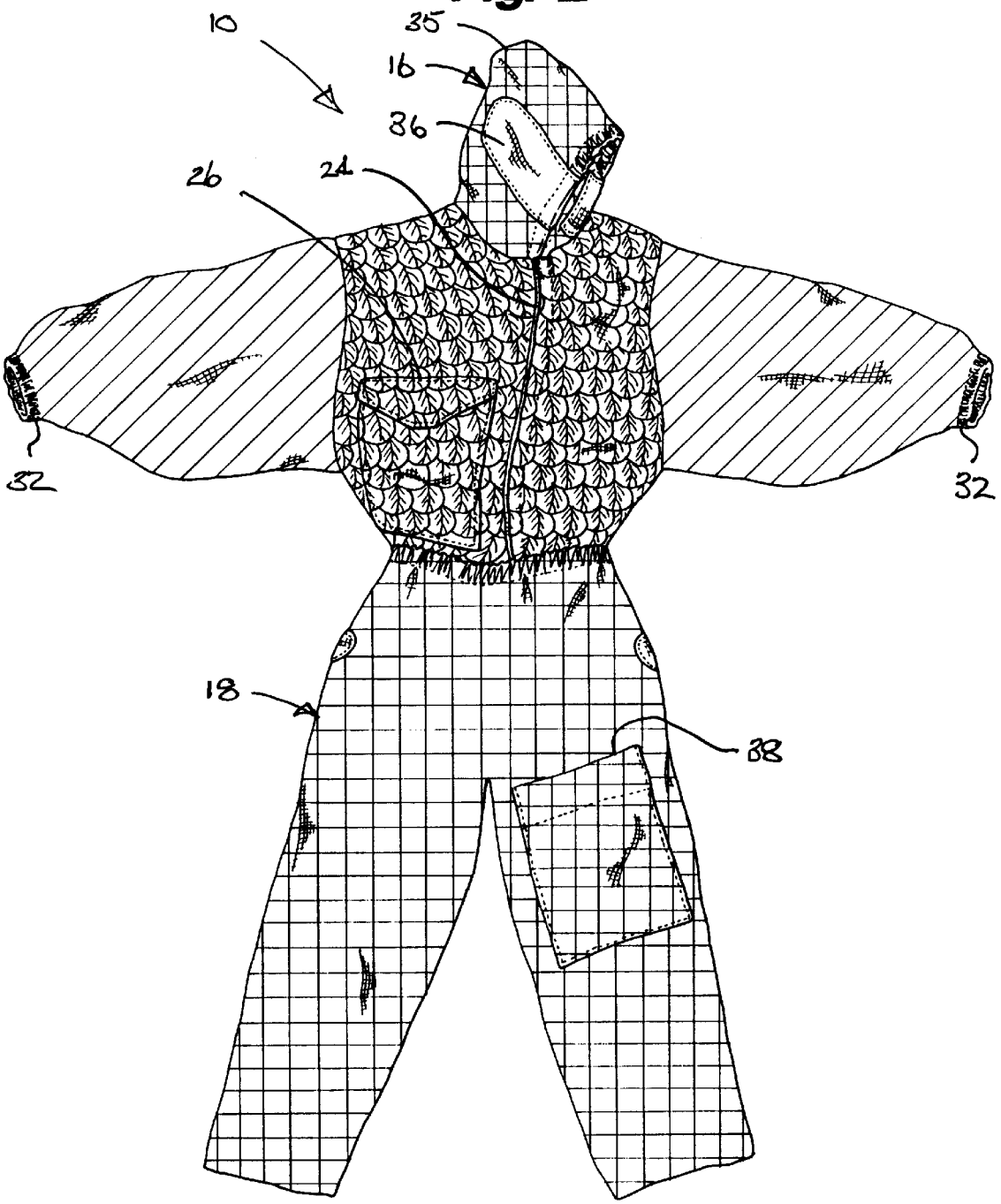
FIG. 2 is a front elevational view of the present invention.
Figure 3:
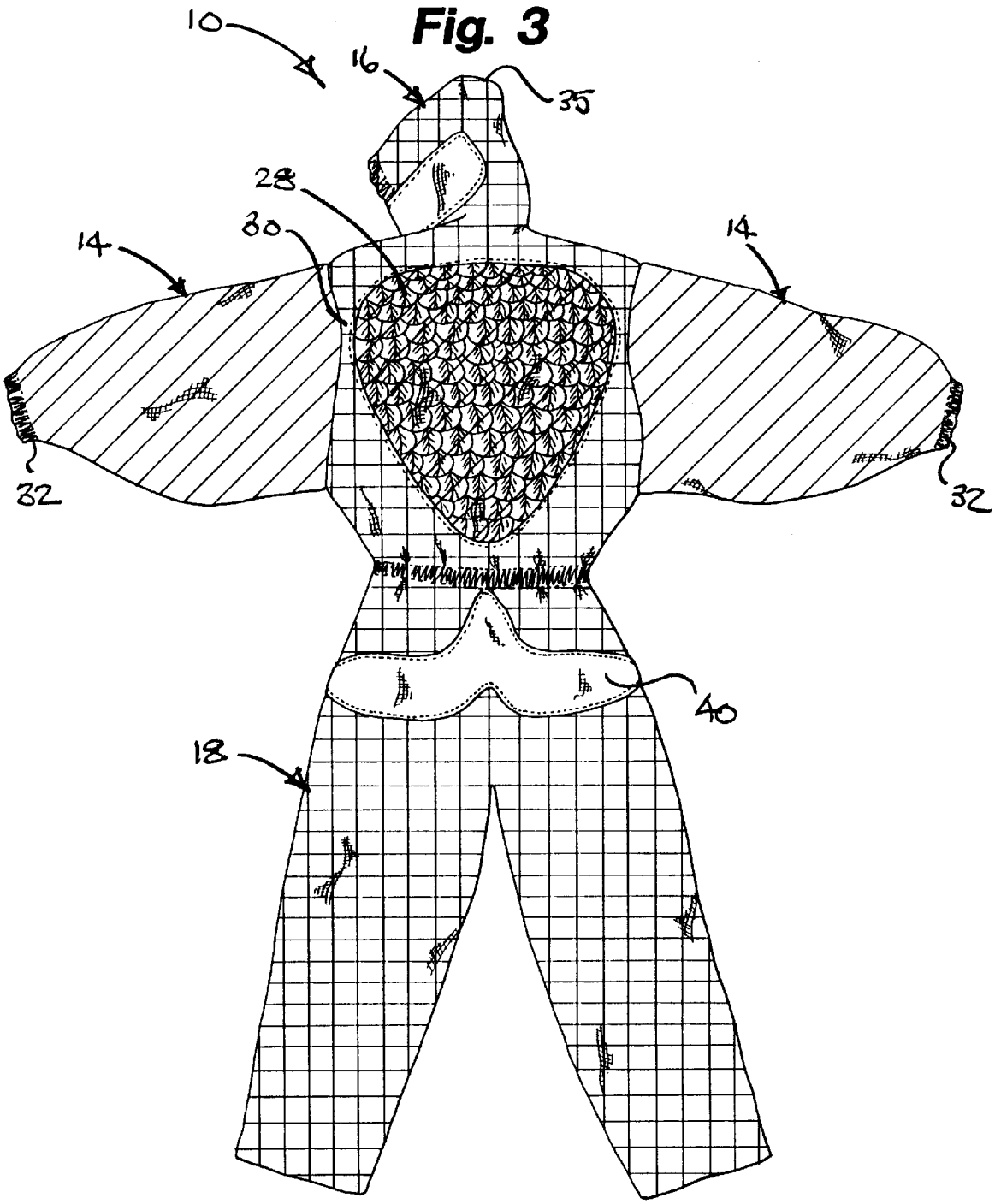
FIG. 3 is rear elevational view of the present invention.

The camouflaged apparel of the present invention is shown generally at 10 at FIGS. 1–3. Apparel 10 has four components: torso 12, arms 14, hood 16, and pants 18 in a unitary combination to form a coverall. The depicted embodiment of the camouflaged apparel 10 is of a Canada goose. It is understood that the camouflaged apparel 10 may also be made to resemble other waterfowl, including snow geese, blue geese, ducks, and swans. Unlike conventional camouflage that is designed to conceal the hunter or other item from detection by the game that is the quarry, the camouflaged apparel of the present invention is designed to be observed by the game that is the quarry and to attract the game to the hunter.

The front torso 20 of the torso 12 is depicted in FIGS. 1 and 2. The front torso 20 has an opening 24 that preferably extends from the hood 16 to the pants 18. The opening may be closed by conventional means including buttons, a zipper, and hook and pile closures. The front torso 20 has a pocket 26 positioned on the lower right side thereof. The pattern of coloring on the front torso 20 is extended to the surface of the pocket 26. It is understood that additional pockets could be included on the front torso 20, as desired.

The coloration of the front torso 20 is designed to replicate the color of the plumage on the breast of a Canada goose. Accordingly, the front torso 20 is preferably tan in color with a superposed feather pattern in brown color. Preferably, the superposed feather pattern is formed on the material of the front torso 20 by a silk screening technique.

The rear torso 22 of the torso 12 is depicted in FIG. 3. The rear torso 22 may optionally have a game pouch formed therein. The openings to the game pouch are typically formed in the sides of the torso 12 beneath the arms 14.

The rear torso 22 is colored to replicate the back and folded wings of a Canada goose. Accordingly, the rear torso 22 is formed of a back panel 28 surrounded by a peripheral panel 30. The back panel 28 is preferably colored in a medium brown color with a superimposed dark brown feather pattern. The peripheral panel 30 is formed of a monolithic black color.

Right and left arms 14 are affixed to the torso 12. The arms 14 preferably have elastic cuffs 32. The arms 14 are preferably colored a monolithic black color.

The hood 16 of apparel 10 is depicted in FIGS. 1–3. The hood 16 may be affixed to the torso 12 or may be selectively detachable therefrom by coupling thereto with the aforementioned closure devices. The hood 16 preferably has an elastic brow 34.

The coloration of the hood 16 is designed to simulate the curved neck of a Canada goose. Accordingly, the back and top portions of the hood 16 comprise neck simulation 35. The neck simulation 35 is preferably monolithic black color. Cheek panels 36 are disposed in the crook of the neck simulation 35. The cheek panels 36 are preferably a monolithic white color.

In the depicted embodiment, apparel 10 is constructed as a coverall. Accordingly, the pants 18 are fixedly joined to torso 12 proximate the waist portion thereof. As depicted, the pants 18 have a single pocket 38 positioned on the thigh portion of the left leg thereof. It is understood that other pockets could be used as desired. The coloration of the front portion of the pants 18, including the pocket 38, is a monolithic black color.

As depicted in FIG. 3, the rear portion of the pants 18 have two joined, kidney-shaped panels on the seat portion of the pants 18. The kidney-shaped panels 40 are preferably monolithic white in color with the remainder of the rear portion of the pants 18 being monolithic black in color.

Figure 4:
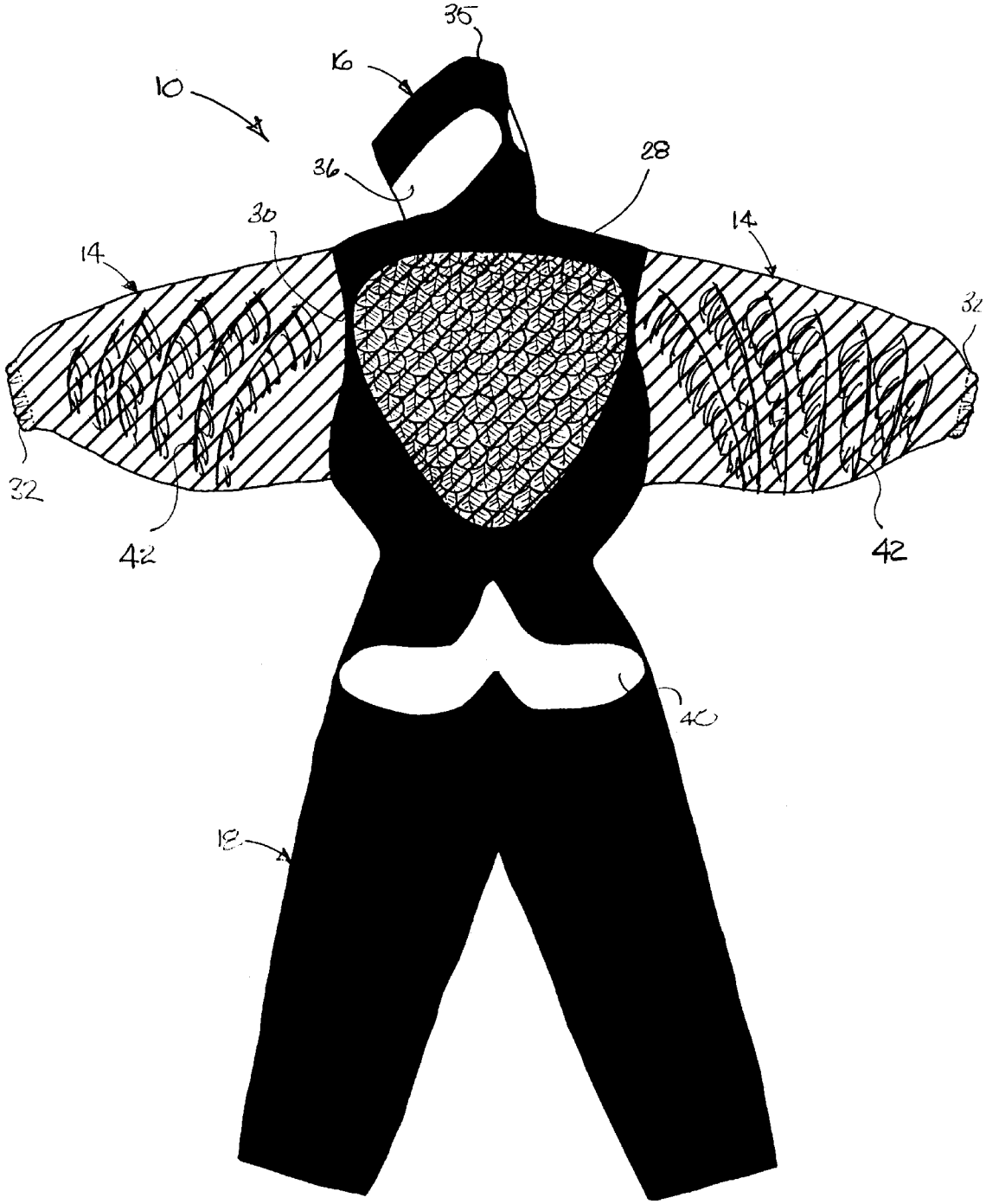
FIG. 4 is rear elevational view of an alternative embodiment of the present invention having the arm portion resemble the wings of a selected waterfowl.

As depicted in FIG. 4, the arms 14 of the apparel 10 have a feathered pattern 42 formed to resemble the wing feather structure of the particular waterfowl that is desired. The feathered pattern 42 is preferably applied by a silk screen method. The feathered pattern 42 is most appropriately applied to the back face of the arms 14, but may also be applied to the front face of the arms 14 as well.

There are a number of other preferred embodiments of the apparel 10. The apparel 10 can be made with the upper portion comprising the torso 12, arms 14, and hood 16 as a jacket separate from the coordinated pants 18. Further, the jacket-length embodiment may be formed as a pullover wherein the opening 24 extends only from the opening of the hood 16 to the midchest region. A longer length parka can also be provided. Such a parka extends downward on the hunter that is wearing the apparel 10 to cover at least a portion of the hunter's hip region. Further, the jacket or parka embodiment may be provided by itself, with the hunter providing the dark colored pants separate therefrom.

It is understood that the apparel 10 can be made of lightweight material for use in warmer climates that may additionally be made of wind and rainproof material.

In operation, the hunter dons the apparel 10 and takes up station in a location that is attractive to the specific species of waterfowl that is being pursued. This may be in a generally open field where the waterfowl may feed or it may be in a slough where the waterfowl may alight. Generally, no means of concealment of the hunter is employed. It is known that flying Canada geese, being decoy-smart, are frequently attracted to fluttering wing -like motions on the ground as distinct from mere static decoys. A tactic for the hunter to employ is to stand or kneel and wave the arms of the apparel 10 to attract the attention of flying geese. In conjunction with an array of conventional geese decoys, such attention getting activity may entice the flying geese to land among the decoys in close proximity to the hunter wearing the apparel 10.

What is claimed is:

1. Camouflaged apparel for use by a hunter in pursuing waterfowl, said apparel being designed to be observed by the pursued waterfowl, comprising:

apparel having indicia thereon, the indicia resembling the coloration of a selected species of waterfowl, said apparel concealing the hunter wearing the apparel and having an exterior appearance that visibly resembles the appearance features of the selected species of waterfowl to entice the waterfowl to approach the concealed hunter.

2. The camouflaged apparel of claim 1 wherein the apparel includes a torso having a back and a front portion, and a right and a left arm operably coupled to the torso, the front portion of the torso having indicia thereon, the indicia being colored to substantially resemble the breast of the selected species of waterfowl, the rear portion of the torso having indicia thereon, the indicia being colored to substantially resemble the back of the selected species of waterfowl, and the at least a portion of the right and a left arms having indicia thereon, the indicia being colored to substantially resemble the wings of the selected species of waterfowl.

3. The camouflaged apparel of claim 2 wherein the apparel includes a hood for covering at least a portion of the head of the hunter and being operably coupled to the torso, at least a portion of the hood having indicia thereon, the indicia being colored to substantially resemble the neck portion of the selected species of waterfowl.

4. The camouflaged apparel of claim 1 wherein the apparel is selected from a list of apparel forms consisting of:

a jacket;

a jacket with coordinated pants a parka;

a parka with coordinated pants; and a coverall.

5. The camouflaged apparel of claim 2 wherein the right and left arms of the apparel each have a front and a rear face, the rear face of right and left arms having indicia thereon, the indicia being the images of feathers imposed thereon, said images being formed to resemble the plumage of the selected species of waterfowl.

6. The camouflaged apparel of claim 1 wherein the coloration of the indicia that is imposed on the apparel resembles the coloration of waterfowl selected from the list consisting of:

Canada goose;

snow goose;

blue goose;

duck; and swan.

7. Camouflaged apparel for use by a hunter in pursuing waterfowl, comprising:

design and coloration of the visible external surface indicia of the apparel being imposed on the apparel to resemble the visible external surface of a selected type of waterfowl, the visible external surface of the apparel acting to decoy the waterfowl.

8. The camouflaged apparel of claim 7 wherein the apparel includes a torso having a back and a front portion, and a right and a left arm operably coupled to the torso, the front portion of the torso being colored to substantially resemble the breast of the selected species of waterfowl, the rear portion of the torso being colored to substantially resemble the back of the selected species of waterfowl, and the at least a portion of the right and a left arms being colored to substantially resemble the wings of the selected species of waterfowl.

9. The camouflaged apparel of claim 8 wherein the apparel includes a hood for covering at least a portion of the head of the hunter and being operably coupled to the torso, at least a portion of the hood being colored to substantially resemble the neck portion of the selected species of waterfowl.

10. The camouflaged apparel of claim 7 wherein the apparel is selected from a list of apparel forms consisting of:

a jacket;

a jacket with coordinated pants a parka;

a parka with coordinated pants; and a coverall.

11. The camouflaged apparel of claim 8 wherein the right and left arms of the apparel each have a front and a rear face, the rear face of right and left arms having the images of feathers imposed thereon, said images being formed to resemble the plumage of the selected species of waterfowl.

12. The camouflaged apparel of claim 7 wherein the coloration of the indicia that is imposed on the apparel resembles the coloration of waterfowl selected from the list consisting of:

Canada goose;

snow goose;

blue goose;

duck; and swan.

13. Camouflaged apparel for use by a hunter in pursuing waterfowl, said apparel being designed to be observed by the pursued waterfowl, comprising:

apparel that resembles the coloration of a selected species of waterfowl, said apparel concealing the hunter wearing the apparel and having an exterior appearance that visibly resembles the appearance features of the selected species of waterfowl to entice the waterfowl to approach the concealed hunter, the apparel including a torso having a back and a front portion, and a right and a left arm operably coupled to the torso, the front portion of the torso being colored to substantially resemble the breast of the selected species of waterfowl, the rear portion of the torso being colored to substantially resemble the back of the selected species of waterfowl, and the at least a portion of the right and a left arms being colored to substantially resemble the wings of the selected species of waterfowl.

14. The camouflaged apparel of claim 13 wherein the apparel includes a hood for covering at least a portion of the head of the hunter and being operably coupled to the torso, at least a portion of the hood being colored to substantially resemble the neck portion of the selected species of waterfowl.

15. The camouflaged apparel of claim 13 wherein the right and left arms of the apparel each have a front and a rear face, the rear face of right and left arms having the images of feathers imposed thereon, said images being formed to resemble the plumage of the selected species of waterfowl.

16. Camouflaged apparel for use by a hunter in pursuing waterfowl, comprising:

design and coloration of the visible external surface of the apparel being imposed thereon to resemble the visible external surface of a selected type of waterfowl, the visible external surface of the apparel acting to decoy the waterfowl, the apparel includes a torso having a back and a front portion, and a right and a left arm operably coupled to the torso, the front portion of the torso being colored to substantially resemble the breast of the selected species of waterfowl, the rear portion of the torso being colored to substantially resemble the back of the selected species of waterfowl, and the at least a portion of the right and a left arms being colored to substantially resemble the wings of the selected species of waterfowl.

17. The camouflaged apparel of claim 16 wherein the apparel includes a hood for covering at least a portion of the head of the hunter and being operably coupled to the torso, at least a portion of the hood being colored to substantially resemble the neck portion of the selected species of waterfowl.

18. The camouflaged apparel of claim 17 wherein the right and left arms of the apparel each have a front and a rear face, the rear face of right and left arms having the images of feathers imposed thereon, said images being formed to resemble the plumage of the selected species of waterfowl.

* * * * *